US008656648B2

(12) United States Patent
Liegeois et al.

(10) Patent No.: US 8,656,648 B2
(45) Date of Patent: Feb. 25, 2014

(54) PANEL SYSTEM

(75) Inventors: David D. Liegeois, Little Suamico, WI (US); Daniel R. Cummings, Appleton, WI (US); Steven C. Gevaert, Green Bay, WI (US)

(73) Assignee: Krueger International, Inc., Green Bay, WI (US)

( * ) Notice: Subject to any disclaimer, the term of this patent is extended or adjusted under 35 U.S.C. 154(b) by 429 days.

(21) Appl. No.: 12/913,206

(22) Filed: Oct. 27, 2010

(65) Prior Publication Data

US 2011/0099929 A1 May 5, 2011

Related U.S. Application Data

(60) Provisional application No. 61/256,036, filed on Oct. 29, 2009.

(51) Int. Cl.
*E04B 2/78* (2006.01)
*E04B 2/00* (2006.01)

(52) U.S. Cl.
USPC ..... 52/36.1; 52/36.6; 52/646; 52/772; 52/770; 52/775

(58) Field of Classification Search
USPC ..... 52/36.1–36.6, 683.1, 651.1, 645–646, 52/677, 772, 695, 770, 775, 731.5, 731.9, 52/204.62, 204.67, 204.68, 204.7, 64, 67, 52/506.07, 506.09, 636, 638, 641, 683, 52/282.1–282.4, 651.01, 481.1, 481.2, 52/483.1; 108/106–108, 156, 164, 177, 108/187–188, 178.4, 182.1–182.5, 183.1; 160/371–372, 374, 377, 130, 181–182, 160/184, 351, 179.1; 182/164, 188
See application file for complete search history.

(56) References Cited

U.S. PATENT DOCUMENTS 1,981,240 A 11/1924 McNeil
2,081,368 A 5/1937 Pretot
(Continued)

OTHER PUBLICATIONS

International Search Report dated Dec. 20, 2010.

*Primary Examiner* — Jeanette E. Chapman
(74) *Attorney, Agent, or Firm* — Andrus Intellectual Property Law, LLP

(57) ABSTRACT

A modular wall panel system including a series of wall panels connectable to each other. Each of the wall panels is formed from a support frame having a pair of spaced vertical posts and an upper header and a lower sill extending between the vertical posts. The lower sill is received within attachment notches formed in each of the vertical posts near the bottom end of each post. The attachment notches are spaced along the length of the vertical post such that the position of the sill can be adjusted. The lower sill includes a trim channel that receives the bottom of a tile mounted to the support frame. A top cap is attached to the header and engages a top end of the tile to aid in retaining the tile on the support frame. The tile may be a segmented tile having a lower portion and an upper portion joined to each other by a segmented trim channel. The segmented trim channel between the upper and lower portions is not connected to the support frame. Each panel can receive a stacking section to extend the height of the panel. The stacking section includes a pair of shortened vertical posts and a header. The stacking section is secured to the support frame through a pair of spaced blades. The lower edge of each panel can be elevated above the floor and the trim panel supported beneath the panels to create an enclosed raceway.

10 Claims, 16 Drawing Sheets

(56) References Cited

U.S. PATENT DOCUMENTS

| | | | | |
|---|---|---|---|---|
| 3,370,389 | A | 2/1968 | Macaluso | |
| 3,517,467 | A | 6/1970 | Propst et al. | |
| 3,731,447 | A | 5/1973 | Dawdy et al. | |
| 3,753,325 | A * | 8/1973 | Stanley et al. | 52/481.2 |
| 3,789,567 | A | 2/1974 | Rae et al. | |
| 3,849,962 | A | 11/1974 | Albinson et al. | |
| 4,008,872 | A | 2/1977 | Thompson | |
| 4,048,768 | A | 9/1977 | Good | |
| 4,104,838 | A | 8/1978 | Hage et al. | |
| 4,250,676 | A | 2/1981 | Presby | |
| 4,330,974 | A | 5/1982 | Fleisch et al. | |
| 4,356,672 | A | 11/1982 | Beckman et al. | |
| 4,423,573 | A * | 1/1984 | Omholt et al. | 52/145 |
| 4,478,019 | A | 10/1984 | Thompson, Jr. | |
| 4,535,577 | A | 8/1985 | Tenser et al. | |
| 4,611,448 | A | 9/1986 | De Long | |
| 4,671,481 | A | 6/1987 | Beard | |
| 4,689,930 | A | 9/1987 | Menchetti | |
| 4,719,731 | A | 1/1988 | Ravotti et al. | |
| 4,785,598 | A | 11/1988 | Stronach | |
| RE32,890 | E | 3/1989 | DeFouw et al. | |
| 4,891,922 | A | 1/1990 | Hozer et al. | |
| 4,905,428 | A | 3/1990 | Sykes | |
| 4,949,519 | A | 8/1990 | Jeffers | |
| 4,971,281 | A | 11/1990 | Steinbeck | |
| 5,025,603 | A | 6/1991 | Johnson | |
| 5,063,715 | A | 11/1991 | Goodman | |
| 5,070,666 | A | 12/1991 | Looman | |
| 5,117,599 | A | 6/1992 | Voss | |
| 5,134,826 | A | 8/1992 | La Roche et al. | |
| 5,142,832 | A | 9/1992 | Branham, Sr. et al. | |
| 5,197,256 | A | 3/1993 | Martin | |
| 5,212,918 | A | 5/1993 | Newhouse et al. | |
| 5,230,492 | A | 7/1993 | Zwart et al. | |
| 5,309,686 | A | 5/1994 | Underwood et al. | |
| 5,377,466 | A | 1/1995 | Insalaco et al. | |
| 5,490,357 | A | 2/1996 | Lin | |
| 5,634,300 | A * | 6/1997 | Huebner et al. | 52/36.1 |
| 5,642,593 | A * | 7/1997 | Shieh | 52/239 |
| 5,664,380 | A | 9/1997 | Hsueh | |
| 5,711,121 | A | 1/1998 | Garver | |
| 5,737,887 | A | 4/1998 | Smeenge | |
| 5,806,258 | A | 9/1998 | Miedema et al. | |
| 5,921,040 | A | 7/1999 | Glashouwer et al. | |
| 5,974,742 | A | 11/1999 | Schreiner et al. | |
| 6,000,180 | A | 12/1999 | Goodman et al. | |
| 6,068,041 | A | 5/2000 | Miles et al. | |
| 6,079,173 | A * | 6/2000 | Waalkes et al. | 52/239 |
| 6,098,358 | A | 8/2000 | Waalkes et al. | |
| 6,112,485 | A | 9/2000 | Beyer et al. | |
| 6,128,876 | A | 10/2000 | Nitschke et al. | |
| 6,155,014 | A * | 12/2000 | Wagner | 52/281 |
| 6,167,664 | B1 | 1/2001 | Reuter et al. | |
| 6,167,665 | B1 | 1/2001 | Dame et al. | |
| 6,178,702 | B1 | 1/2001 | Hand et al. | |
| 6,202,381 | B1 | 3/2001 | Dame et al. | |
| 6,223,485 | B1 | 5/2001 | Beck et al. | |
| 6,226,849 | B1 | 5/2001 | Beck et al. | |
| 6,250,032 | B1 | 6/2001 | Davis et al. | |
| 6,260,324 | B1 | 7/2001 | Miedema et al. | |
| 6,279,278 | B1 | 8/2001 | Morris et al. | |
| 6,295,764 | B1 | 10/2001 | Berridge et al. | |
| 6,301,847 | B1 | 10/2001 | Beck et al. | |
| 6,314,687 | B1 | 11/2001 | Schondelmayer et al. | |
| 6,330,773 | B1 | 12/2001 | MacDonald et al. | |
| 6,336,298 | B1 | 1/2002 | Chou | |
| 6,339,907 | B1 | 1/2002 | Dame et al. | |
| 6,341,457 | B1 | 1/2002 | Aerts et al. | |
| 6,351,917 | B1 | 3/2002 | MacDonald et al. | |
| 6,367,213 | B1 | 4/2002 | Reuter et al. | |
| 6,389,773 | B1 | 5/2002 | Reuter et al. | |
| 6,393,782 | B1 | 5/2002 | Berridge et al. | |
| 6,393,783 | B2 | 5/2002 | Emaus et al. | |
| 6,513,288 | B1 * | 2/2003 | MacDonald et al. | 52/239 |
| 6,550,879 | B1 | 4/2003 | Kurrasch et al. | |
| 6,619,008 | B1 | 9/2003 | Shivak et al. | |
| 6,711,871 | B2 | 3/2004 | Beirise et al. | |
| 6,718,717 | B2 | 4/2004 | Henderson et al. | |
| 6,729,085 | B2 | 5/2004 | Newhouse et al. | |
| 6,754,998 | B2 | 6/2004 | Diffrient et al. | |
| 6,820,388 | B2 | 11/2004 | Newhouse et al. | |
| 6,871,920 | B2 | 3/2005 | Greenwald et al. | |
| 6,926,378 | B2 | 8/2005 | Greenwald et al. | |
| 7,127,865 | B2 | 10/2006 | Douglas | |
| 7,150,127 | B2 * | 12/2006 | Underwood et al. | 52/36.1 |
| 7,310,918 | B1 | 12/2007 | Reuter et al. | |
| 7,455,535 | B2 | 11/2008 | Insalaco et al. | |
| 7,540,115 | B2 | 6/2009 | Metcalf et al. | |
| 7,565,772 | B2 | 7/2009 | Waalkes et al. | |
| 7,661,237 | B2 * | 2/2010 | Jakob-Bamberg et al. | 52/506.08 |
| 8,215,081 | B2 * | 7/2012 | Cummings et al. | 52/745.05 |
| 2002/0100236 | A1 | 8/2002 | Kuipers et al. | |
| 2004/0177573 | A1 | 9/2004 | Newhouse et al. | |
| 2007/0033894 | A1 | 2/2007 | Underwood et al. | |
| 2007/0034754 | A1 | 2/2007 | McKeon | |
| 2009/0173016 | A1 | 7/2009 | Metcalf et al. | |

* cited by examiner

FIG. 5
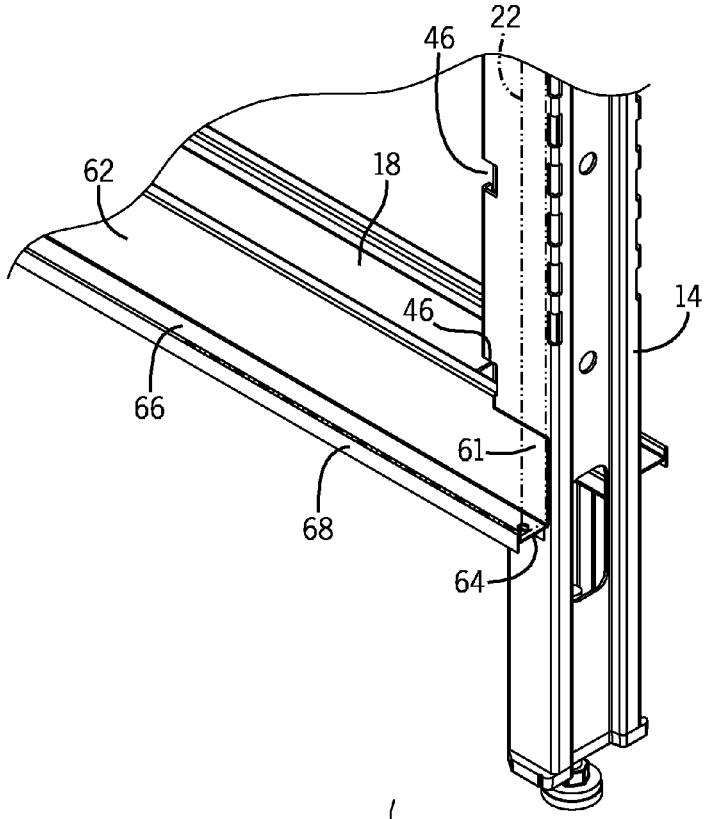
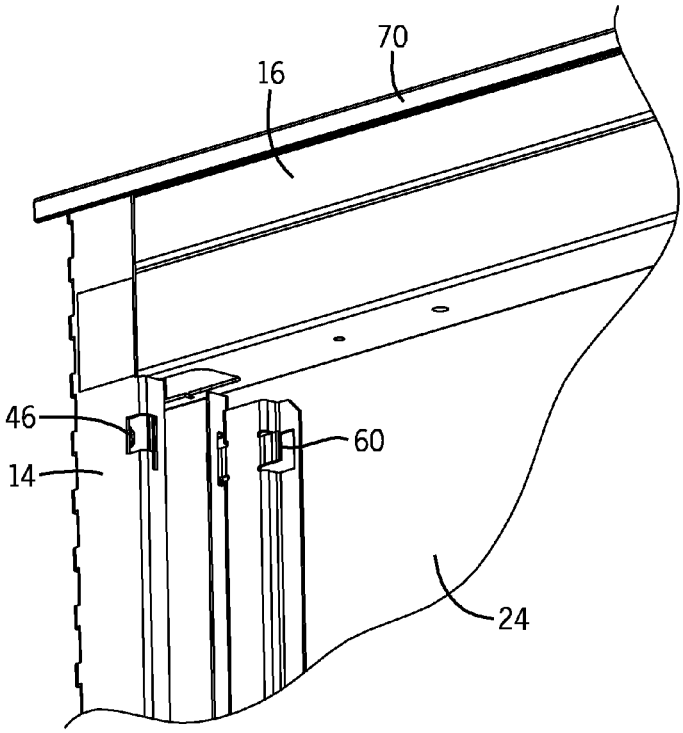
FIG. 6

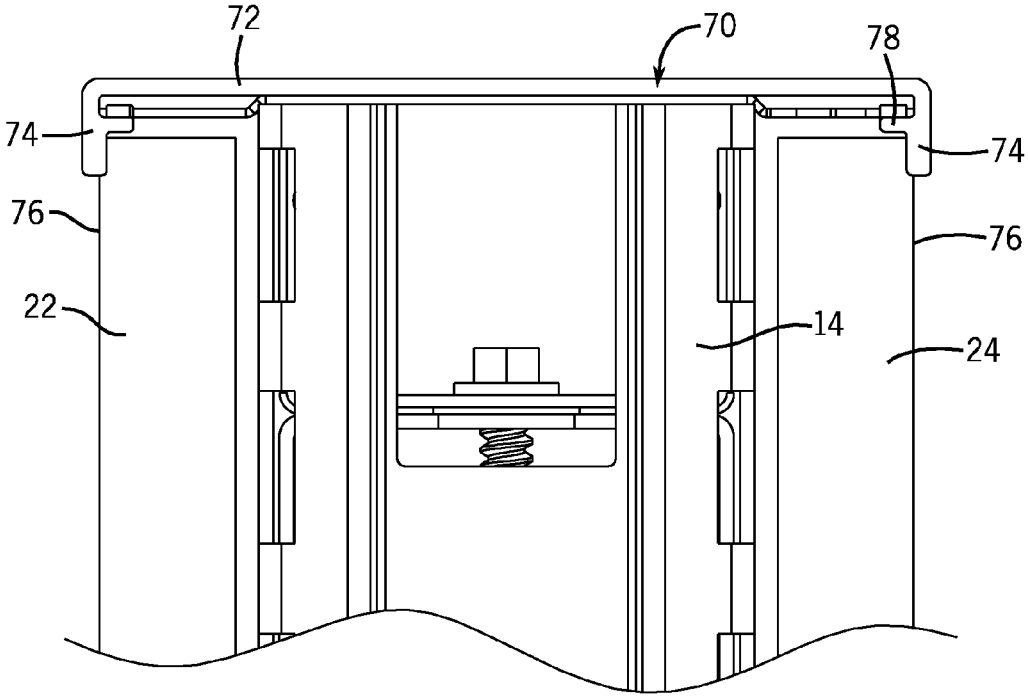
FIG. 7
FIG. 9
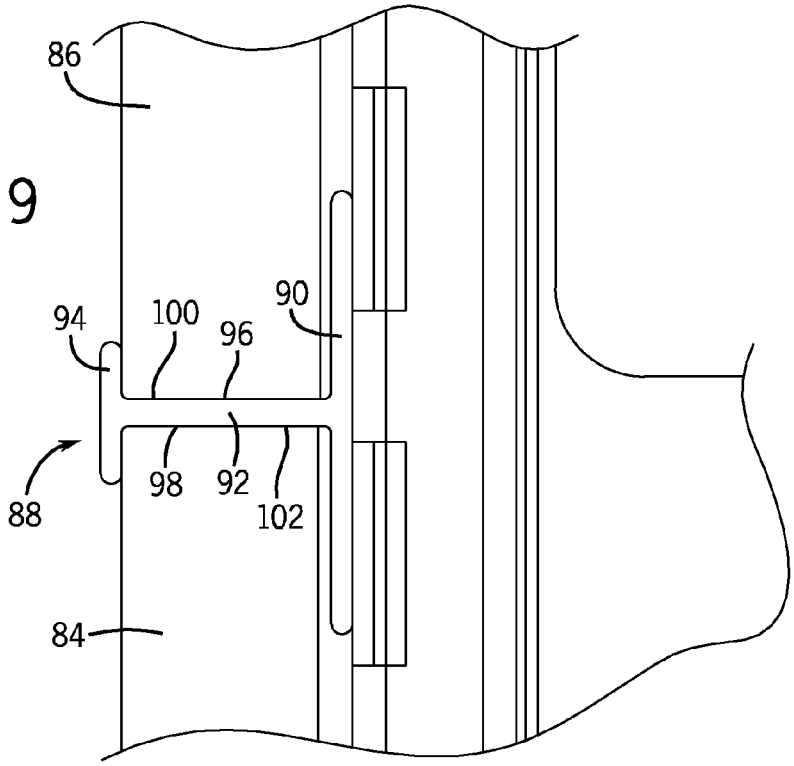

FIG. 20
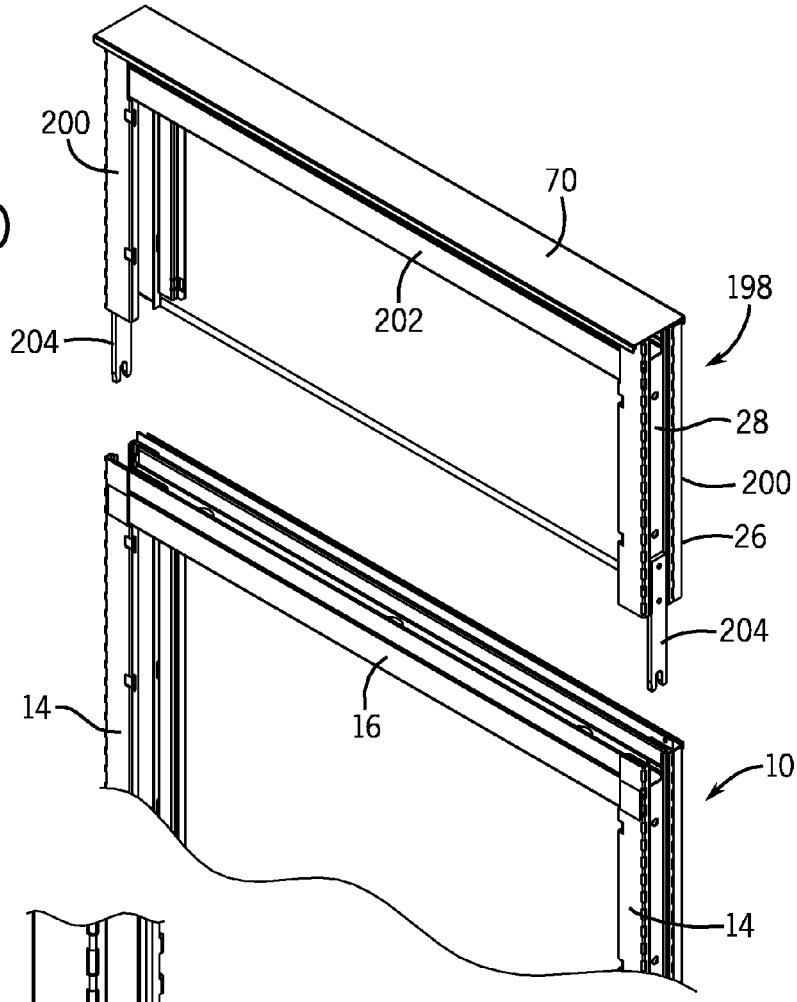
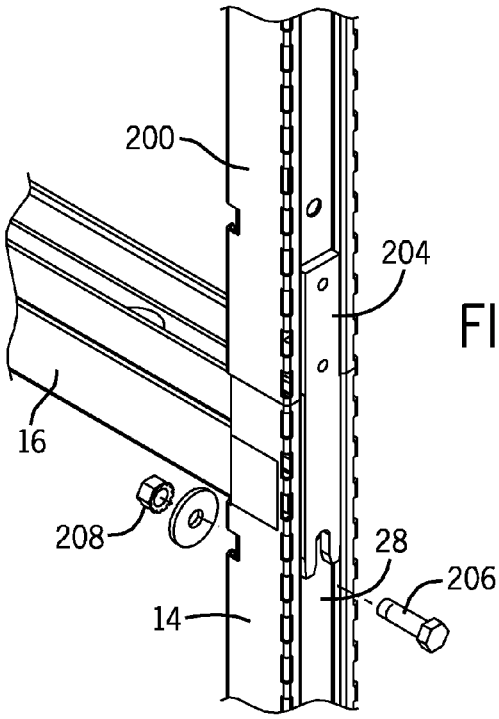
FIG. 21

FIG. 22
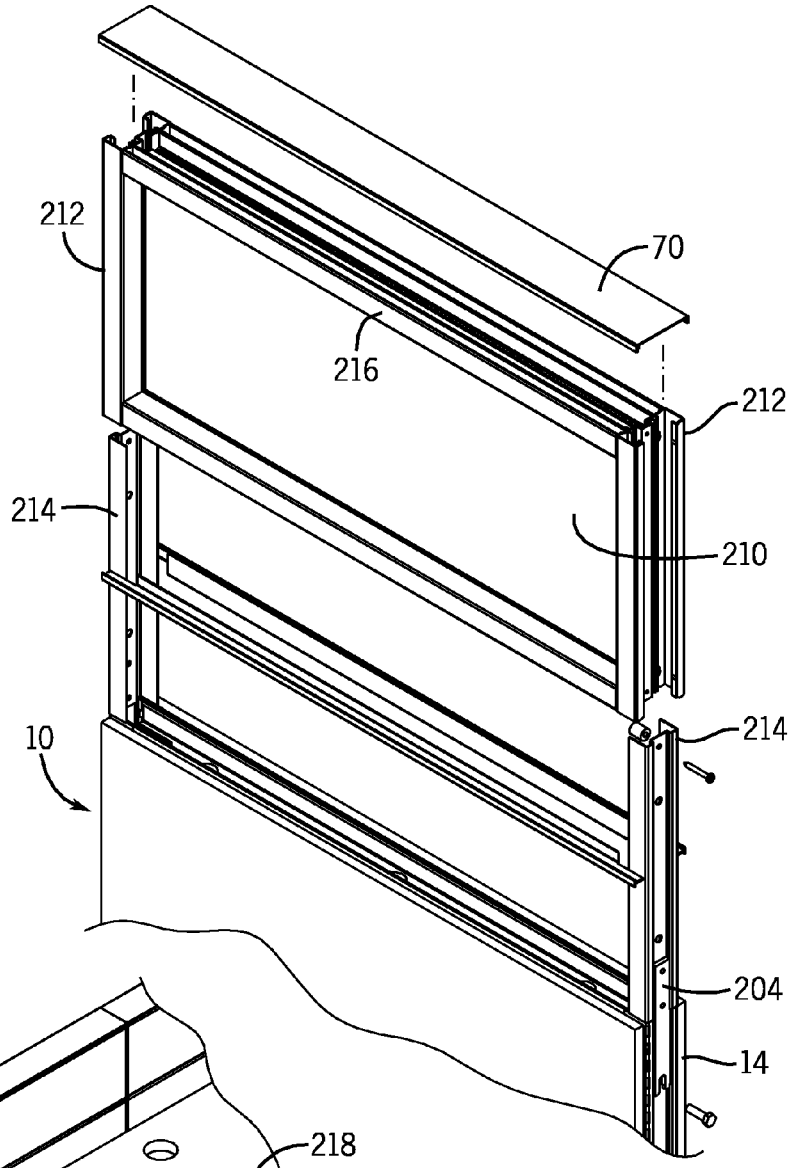
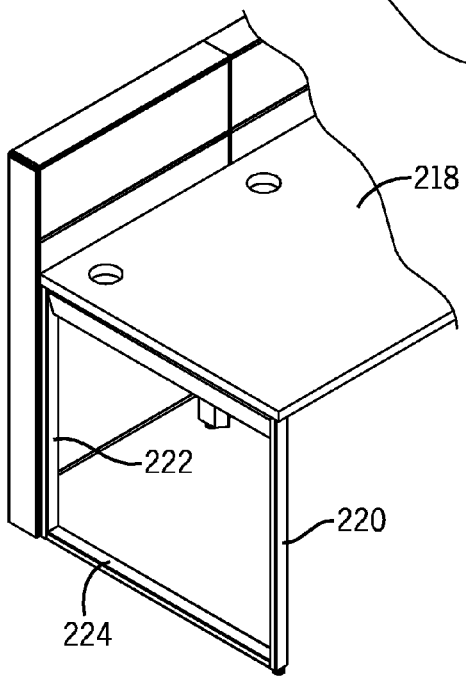
FIG. 23

FIG. 24
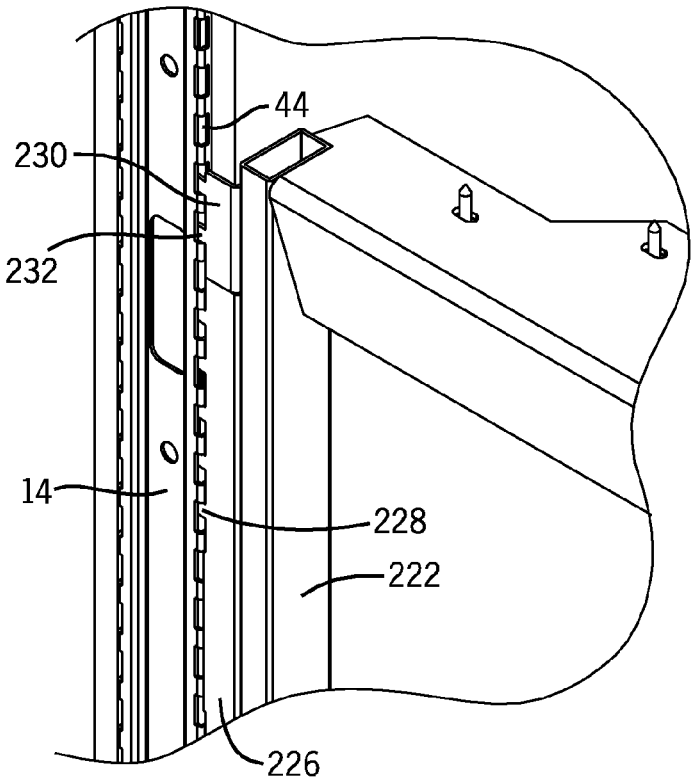
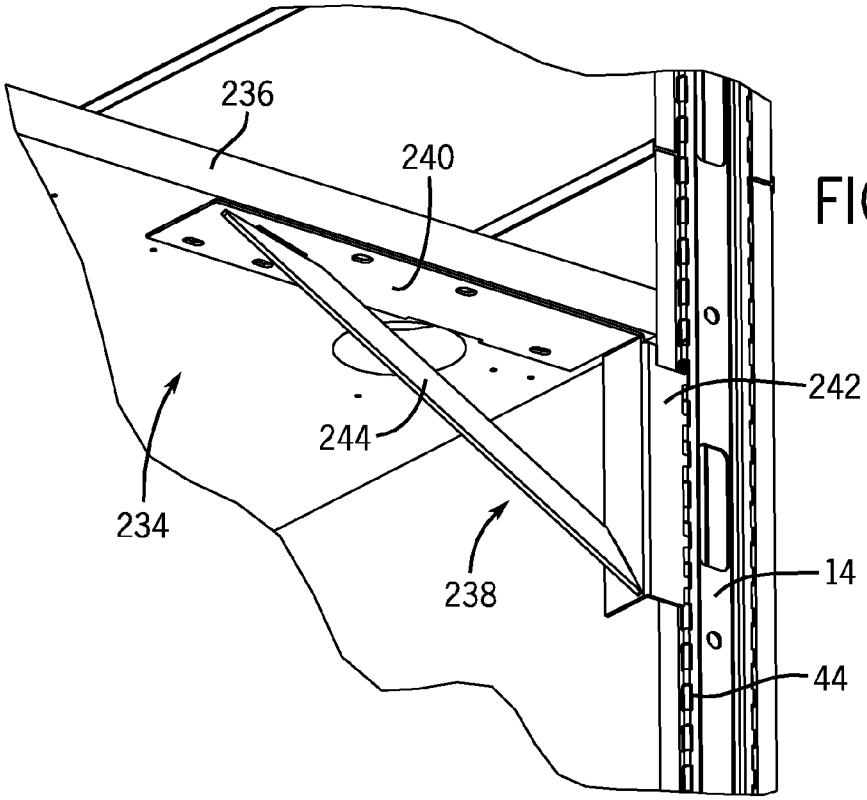
FIG. 25

FIG. 26
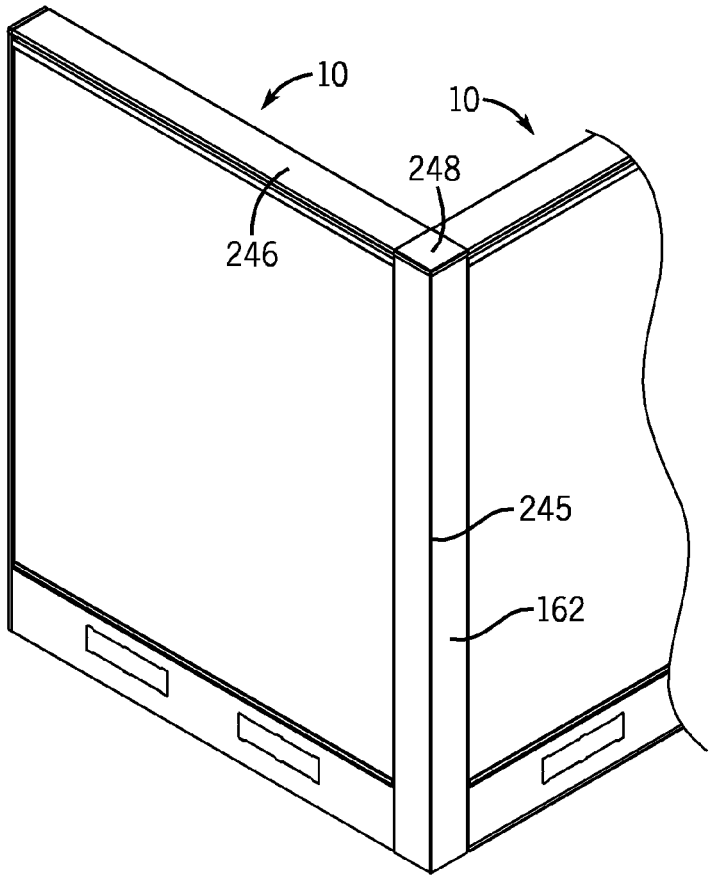
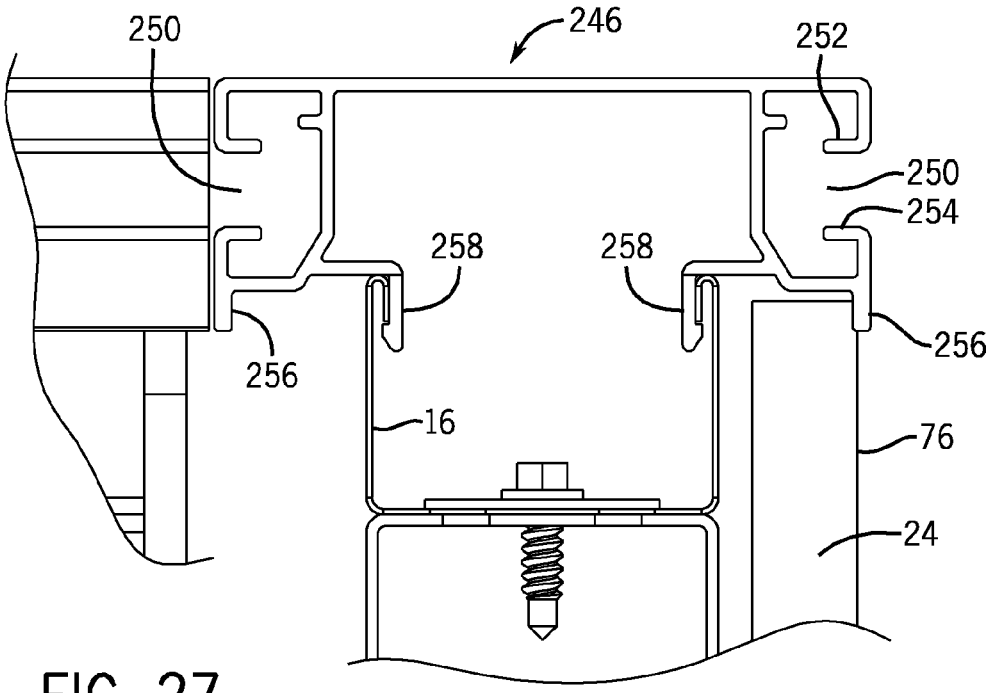
FIG. 27

PANEL SYSTEM

CROSS-REFERENCE TO RELATED APPLICATION

The present application is based on and claims priority to U.S. Provisional Patent Application Ser. No. 61/256,036 filed on Oct. 29, 2009.

BACKGROUND OF THE INVENTION

The present disclosure generally relates to a modular wall panel system. More specifically, the present disclosure relates to the construction of the modular wall panel system and the individual structural components required to form the panel system.

Panel-type wall systems are commonly used to divide space in an open-plan office environment. In a typical modular panel-type wall system, a number of wall panels are interconnected together in a configuration suitable for the intended use of the space. Each wall panel typically includes a structural frame to which a pair of tiles are mounted. The tiles may be broadly classified as either decorative tiles or functional files. Decorative tiles typically have an acoustic insulating material covered by an appropriate finishing material such as fabric, metal or wood and are designed to provide sound proofing and aesthetic appearance. Functional tiles generally have a frame that supports functional components, such as a tool rail, one or more hooks, an opening, a window, a shelf, a marker board, paper management components, etc.

When attaching tiles to the frame of the wall panel system, it is desirable to secure the tiles to the frame so that the tiles, which may be heavy, expensive, or both, are positively secured to the frame. Inadvertent placement of a tile on a frame without the proper secure connection may not provide adequate support and could allow a tile to fall, causing damage or injury to those in the vicinity of the tile.

In many configurations, electrical power connections and communication cables, such as Ethernet cables and telephone cords, must pass through the panels that define the modular wall panel system. Since the computer cables and telephone wires often interconnect multiple office spaces, it is desirable for the computer cables and telephone wires to be concealed within the individual panels of the panel system. Further, since the modular wall panel system can be utilized in many different types of office environments, it is desirable that the modular wall panel system be configurable depending upon the specific need of the office environment.

Since modular panel-type wall systems must be shipped from a manufacturer to the location where the wall system is installed, it is desirable that the individual components needed to construct the panel-type wall system can be shipped in as little space as possible to reduce shipping costs. Therefore, it is desirable for individual components of the wall system to be shipped in a compact, space saving configuration and assembled on site after shipping.

SUMMARY OF THE INVENTION

The present disclosure generally relates to a wall panel system including a series of wall panels that can be selectively oriented in a desired configuration. The wall panel system includes a series of individual operating components that allow the wall panel system to be configured and reconfigured as desired.

The modular wall-type panel system includes a series of individual panels that each includes a support frame formed from a pair of spaced vertical posts, a horizontal top header and a lower sill. The lower sill is attached between the pair of spaced vertical posts through the interaction between portions of the lower sill and attachment notches formed in the vertical posts. In one embodiment of the disclosure, each vertical post includes a series of attachment notches that are selectively spaced along the length of the vertical post. The spaced attachment notches allow the lower sill to be selectively mounted at different locations along the length of the vertical post.

The lower sill includes a bottom trim channel. The bottom trim channel is sized to receive a lower edge surface of a tile to be mounted to the support frame. The bottom trim channel receives the tile and supports the entire weight of the tile.

In one embodiment of the disclosure, a back surface of each tile includes one or more stiffener brackets, each of which includes engagement tabs. When the tile is supported along the bottom trim channel, the engagement tabs of the stiffener bracket are received in attachment notches formed near the top end of the vertical posts. The engagement of the tabs formed on the stiffener bracket helps retain the tile along the support frame without having to support the weight of the tile.

In one embodiment of the disclosure, each panel includes a top cap that is attached to the support frame. The top cap includes depending sidewalls that entrap the tiles against the support frame when the tiles are supported by the bottom trim channels. The top cap provides not only a decorative appearance for the panel system, but also aids in retaining the tiles against the support frame.

In one embodiment of the disclosure, at least one tile mounted to the support frame is formed as a segmented tile. The segmented tile includes a lower portion and an upper portion that are joined to each other by a segmented trim channel. The segmented trim channel includes an upper edge of the lower tile portion and a lower edge of the upper tile portion. The segmented trim channel is not affixed to the pair of vertical posts that form the support frame.

In one embodiment of the disclosure, each of the vertical posts that form the support frame includes a pair of contact projections that protrude from a recessed center section. When two panels are positioned adjacent to each other, the contact projections of a first panel engage the contact projections of a second panel. The engagement between the contact projections prevents light from passing between the adjacent panel sections.

In one embodiment of the disclosure, a stacking section can be attached to the support frame of any panel to extend the height of the support frame. The stacking section is formed from a pair of shortened vertical posts that are joined to each other by a header. The lower end of the stacking section does not include any cross member and is thus open to the header of the support frame upon installation.

The stacking section includes an attachment blade attached to each of the shortened vertical posts. The attachment blade is secured to the vertical posts of the support frame to mount the stacking section to the support frame. In one embodiment of the disclosure. the stacking section includes a glass panel positioned between the pair of shortened vertical posts. The glass panel allows light to pass through the stacking section, which is positioned above the support frame and corresponding decorative tile.

In accordance with the disclosure, when two wall panels are joined to each other to define a 90° corner, a light blocking attachment assembly is used. The light blocking attachment assembly includes a series of support blocks that have a generally square cross-section and four attachment surfaces.

Each of the panels positioned at a 90° angle relative to each other are securely attached to one attachment surface of the support block. Preferably, a light blocking bracket is positioned along the interior corner defined by the joined pair of panels. The light blocking bracket includes a pair of flanges joined to each other at a 90° angle to prevent light from passing between the joined corner sections.

A corner trim section is attached to the series of support blocks to provide a decorative appearance for the outer corner of the joined panel sections. Preferably, the corner trim section can be slid along the length of the panels and retained within the support blocks without additional tools or connectors.

The modular wall-type panel system may further include a support surface having a front leg and a rear leg where the rear leg is secured to a vertical post of one of the wall panels. A movable bracket is attached to the rear leg to secure the rear leg to the vertical post When one or more of the wall panels is constructed such that the tile mounted to the support frame is positioned above the floor, the wall panel system can include a raceway mounting bracket to support a pair of trim panels to enclose a raceway. The trim panels are positioned beneath the tile and enclose an open raceway that allows wires and communication cables to pass between adjacent panels.

Various other features, objects and advantages of the invention will be made apparent from the following description taken together with the drawings.

BRIEF DESCRIPTION OF THE DRAWINGS

The drawings illustrate the best mode presently contemplated of carrying out the disclosure. In the drawings:

FIG. 5 is a magnified view showing one of the lower sills attached between the vertical posts of the support frame;

FIG. 6 is a view illustrating the connection between one of the tiles and the support frame;

FIG. 7 is a side view of a top cap used to retain a pair of tiles on each side of the support frame of a panel;

FIG. 9 is a side view illustrating a trim channel used to support upper and lower sections of one of the tiles;

FIG. 20 is an exploded view illustrating the mounting of a stacking section onto an existing panel;

FIG. 21 is a magnified view illustrating the attachment of the stacking section;

FIG. 22 is an exploded view of a stacking section including a transparent section;

FIG. 23 is a perspective view illustrating the attachment of a work surface to the support frame;

FIG. 24 is a magnified view illustrating the physical attachment of the work surface to the vertical upright;

FIG. 25 is a view illustrating a mounting bracket used to provide support for the work surface;

FIG. 26 is a perspective view of a corner of the panel system; and

FIG. 27 is a section view of the top cap used on the upper end of the panel section.

DETAILED DESCRIPTION OF THE INVENTION

Figure 1:
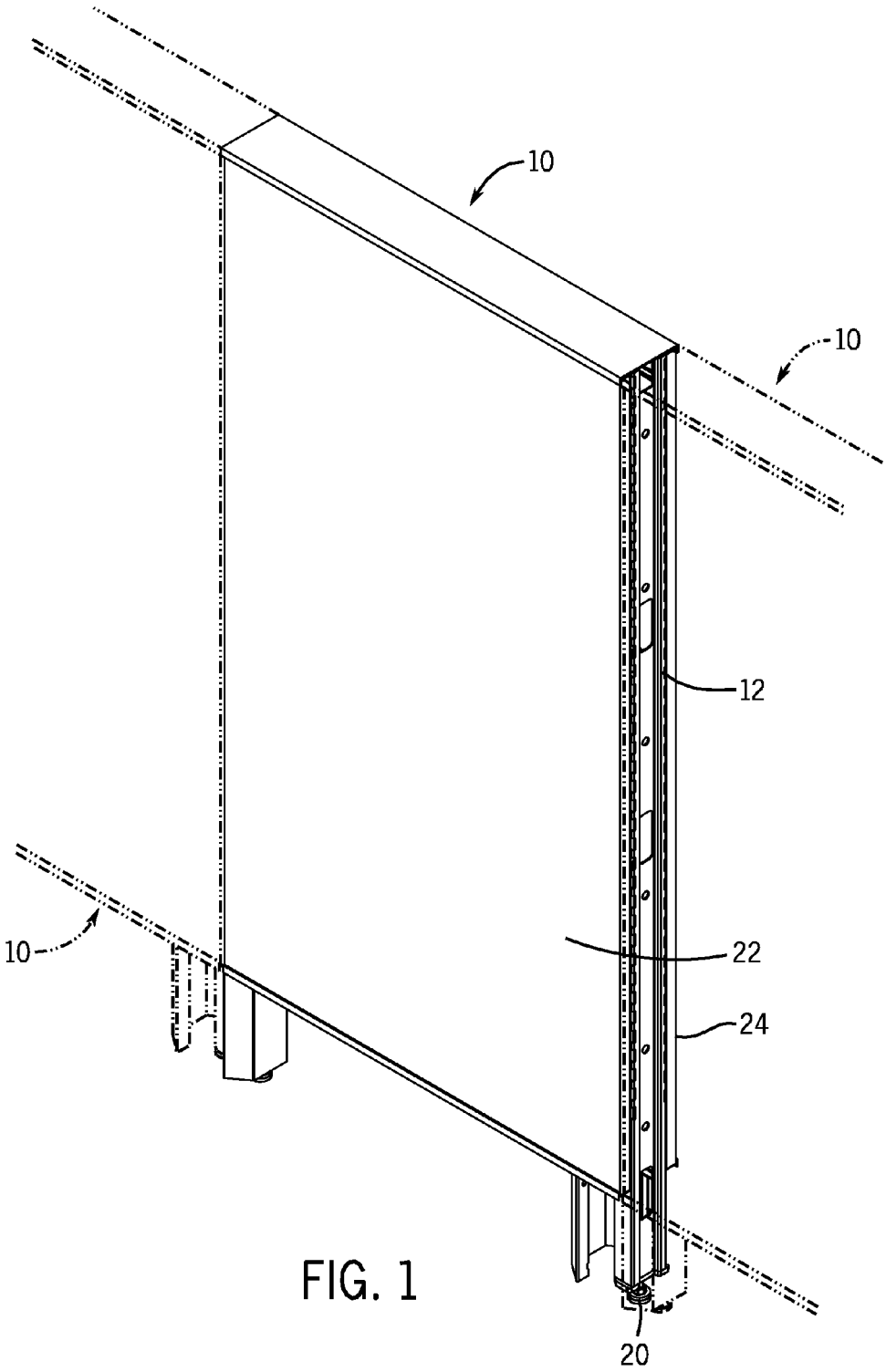
FIG. 1 is a perspective view of one panel of a series of interconnected panels of a modular wall panel system.

FIG. 1 generally illustrates a modular panel 10 that can be used as part of a modular panel-type wall system to divide an open-plan office environment. In the embodiment shown in FIG. 1, the modular panel 10 is shown connected to a pair of adjacent modular panels 10 shown in phantom. The modular panel 10 is part of a wall system that can be configured in various different manners and includes a variety of features and components to be described in greater detail below.

Figure 2:
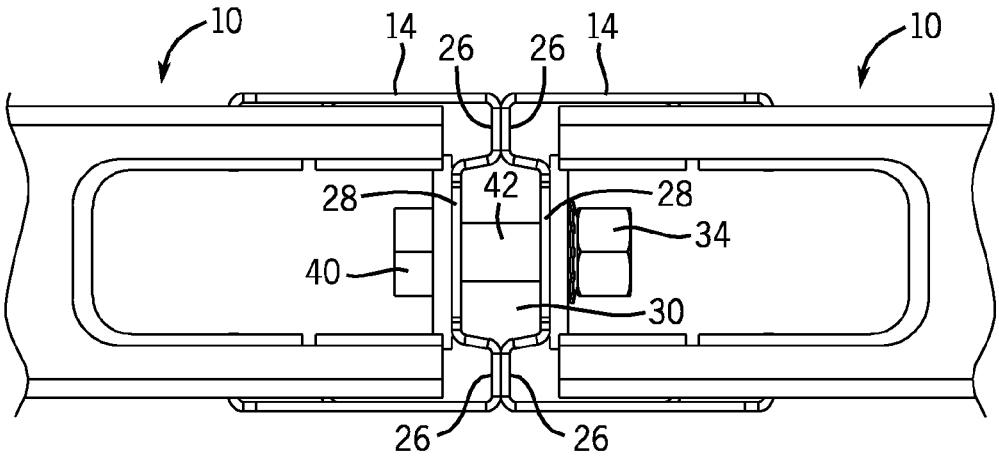
FIG. 2 is a top view showing the interconnection between two panels of the modular wall panel system.
Figure 3:
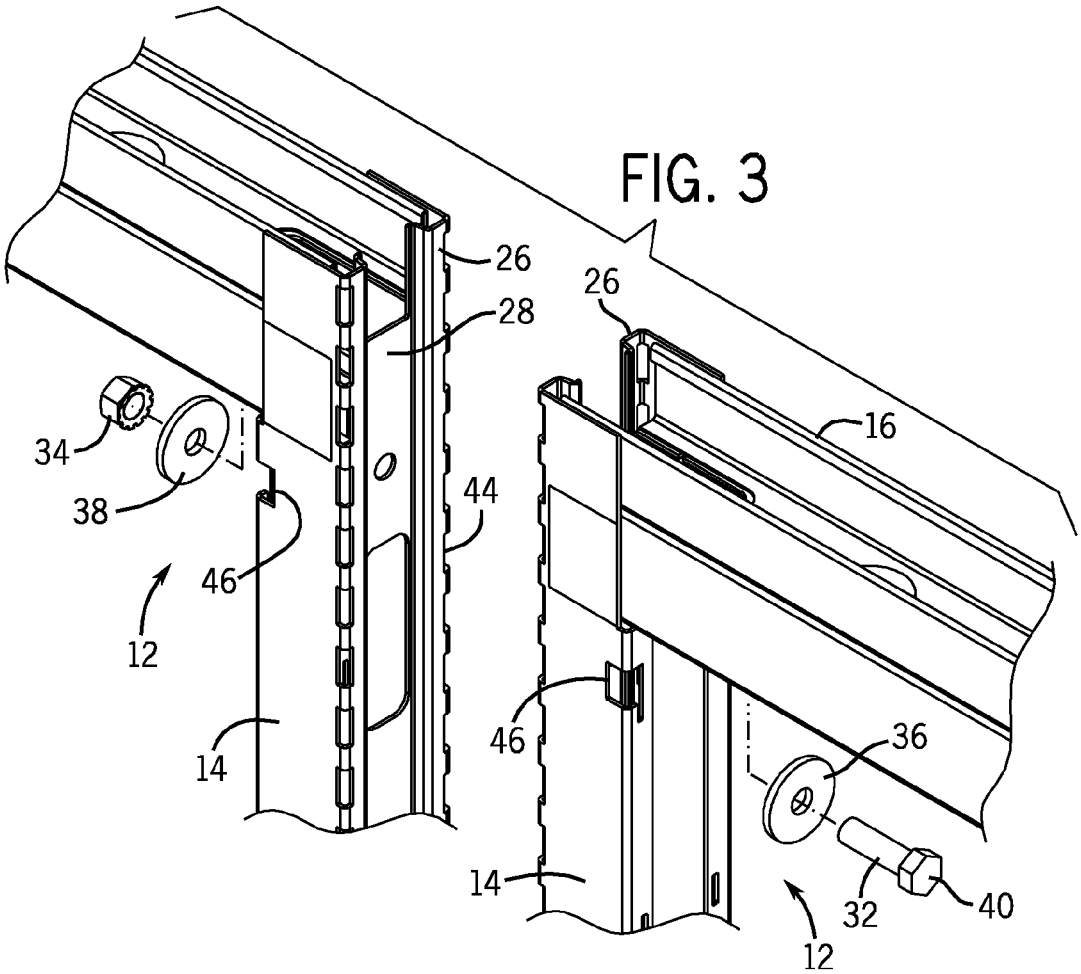
FIG. 3 is an exploded view illustrating the connection between the support frames of a pair of panels.

Each of the modular panels 10 shown in FIGS. 1 and 3 includes a structural support frame 12 preferably formed from an extruded metallic material. The support frame 12 includes a pair of spaced vertical posts 14. The vertical posts 14 are interconnected by a pair of cross supports that include a header 16 (FIG. 3) and a lower sill 18 (FIG. 5). The header 16 and sill 18 provide structural stability for the pair of spaced vertical posts 14. Referring back to FIG. 1, each of the vertical posts 14 includes an adjustable foot 20 that allows for orientation of the support frame to be adjusted to compensate for an uneven support surface. In the embodiment shown in FIGS. 2 and 3, each of the vertical posts 14, as well as the header 16, is a generally hollow member to reduce the overall weight of the modular panel 10 and allow for data or power cables to pass through the structural components of the modular panel 10.

In the embodiment shown in FIG. 1, the support frame 12 receives both a first tile 22 and a second tile 24 to complete the modular panel 10. In the embodiment illustrated in FIG. 1, the first tile 22 and the second tile 24 have an identical configuration such that the first and second tiles 22, 24 can be mounted to either side of the support frame 12. In the embodiment shown, each of the tiles 22, 24 are constructed using a wood fiber board core (particle board) in which the fibers are bonded together with starch fillers. However, other relatively rigid substrates, such as fiberglass or steel, can be used in place of the particle board while operating within the scope of the present disclosure. In the embodiment illustrated, the external surface of the core of each of the tiles 22, 24 receives a flame retardant prime coat and fabric is laminated directly onto the exterior surface of the core using a hot melt adhesive. Although fabric is shown and described as being attached to the exterior surface of both of the tiles 22, 24, it should be understood that other types of decorative material could be utilized while operating within the scope of the present disclosure.

FIGS. 2 and 3 disclose the panel-to-panel in-line connection between adjacent panels of the modular panel system. As shown in FIG. 2, the pair of vertical posts 14 are positioned adjacent to each other when the modular panels 10 are to be joined. Each of the vertical posts 14 includes a pair of protruding contact projections 26 that are separated from each other by a recessed center section 28. As illustrated in FIG. 2, the spacing between the center sections 28 creates an open cavity 30.

Before the decorative tile are attached to the support frame, a series of connectors, such as bolt 32 and locking nut 34 are used to secure the pair of vertical posts 14 to each other. In the embodiment shown, a pair of washers 36, 38 is used to provide mounting support for the nut 34 and the head 40 of the bolt 32. Shaft 42 extends through the open cavity 30 as illustrated in FIG. 2.

When the pair of vertical posts 14 are joined to each other as shown in FIG. 2, the contact projections 26 on the mating vertical posts 14 contact each other. When the nut 34 is tightened onto the bolt 32, the contact projections 26 are brought into vertical contact with each other, preventing light from passing between the joined sections, which may not be possible if the contact surface of each vertical post 14 were planar.

As illustrated in FIG. 3, each of the vertical posts 14 includes a series of open slots 44 formed in a corner section of the contact protrusion. Additionally, each of the vertical posts 14 includes a series of spaced attachment notches 46 that are used to retain the decorative tiles to the support frame in the manner to be described in detail below.

Figure 4:
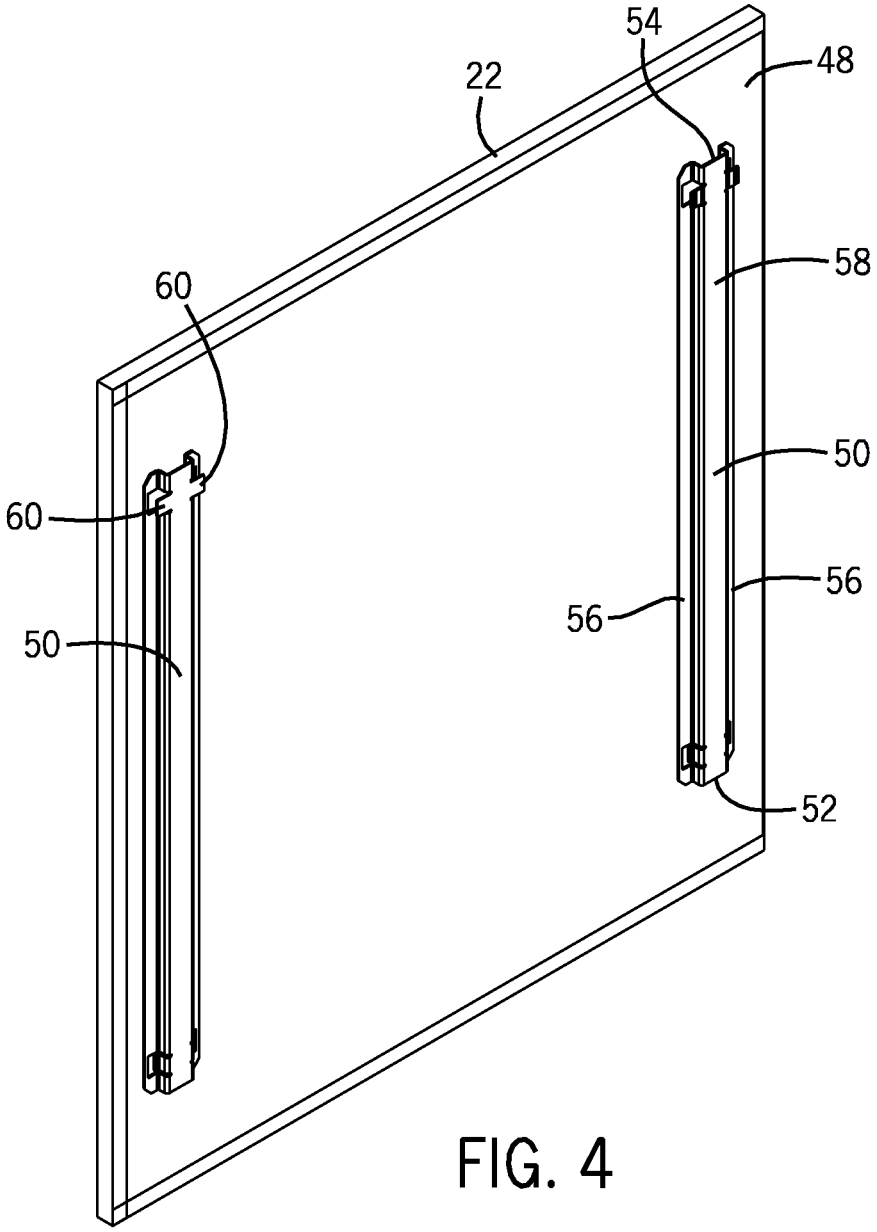
FIG. 4 is a back view of a tile to be mounted to a support frame to form a wall panel, illustrating the mounting arrangement used to secure the tile to the support frame.

FIG. 4 illustrates a back surface 48 of the first tile 22. Although the first tile 22 is shown in FIG. 4, it should be understood that the same configuration is used in forming the second tile 24 (FIG. 1). The interior surface 48 of each of the tiles receive a pair of vertically-oriented stiffener brackets 50. The stiffener brackets 50 provide additional strength and stability for each of the interior and exterior tiles as well as act as a device for securing each of the tiles to the support frame. In the embodiment illustrated, each of the stiffener brackets 50 is formed from a metallic material and is adhesively attached to the inner surface 48 of the tile. Although an adhesive is the preferred method of attachment of the stiffener bracket 50, it should be understood that other types of attachments, such as mechanical connectors such as screws, could be utilized while operating within the scope of the present disclosure. Each of the stiffener brackets 50 has a length extending between a lower end 52 and an upper end 54. The length of each stiffener bracket 50 is less than the overall length of the tile, as shown in FIG. 4.

Each of the stiffener brackets 50 is formed from a single piece of stamped metallic material. The metallic material used to form each of the brackets 50 is bent into the general configuration shown in FIG. 4. As illustrated, each of the stiffener brackets 50 includes a pair of generally parallel attachment flanges 56 that are offset from each other by a center section 58. The center section 58 includes a pair of engagement tabs 60 that extend from the center section 58 at both the upper end 54 and the lower end 52. The pair of engagement tabs 60 allow the configuration of the tile to be such that the tile can be mounted to the support frame in any orientation.

Referring now to FIG. 5, the support frame includes the lower sill 18 that provides stability for the support frame, as described. The lower sill 18 is securely supported along a lower end of the vertical post 14. An engagement portion of the sill 18 is received and retained in one of the attachment notches 46 formed in the vertical post 14. The sill 18 includes outer ends 61 that extend on both sides of the vertical post 14. The outer ends 61 are part of a pair of vertical walls 62 positioned on opposite sides of the vertical post 14. Each of the vertical walls 62 are connected to and support a lower trim channel 64 defined by a horizontal support wall 66 and a vertical flange 68. The length of the support wall 66 between the vertical wall 62 and the flange 68 is approximately equal to the width of the first and second tiles 22, 24. As illustrated in FIG. 5, a bottom end of the first tile 22, which is shown in phantom, rests upon the support wall 66 such that the entire weight of the tile 22 is supported by the trim channel 64.

As illustrated in FIG. 5, the vertical post 14 includes a series of attachment notches 46 spaced from each other near the bottom end of the vertical post 14. The attachment notches 46 are preferably spaced from each other at approximately eight inch intervals such that the lower sill 18 can be positioned at various locations depending upon the size of the tile to be supported on the support frame and the desired space between the bottom edge of the tile 22 and the floor.

Referring now to FIG. 6, when the interior and exterior tiles are supported along their lower end by the trim channel 64, the engagement tabs 60 are each received within one of the attachment notches 46 formed near the upper end of the vertical post 14. As described previously, the entire weight of the tiles are supported by the trim channels 64 such that the engagement tabs 60 are received in the attachment notches 46 to only prevent the tile from falling away from the support frame.

FIG. 7 illustrates a top cap 70 mounted to the top end of each panel to further retain the first tile 22 and the second tile 24. Top cap 70 includes a generally horizontal top wall 72 and a pair of spaced vertical outer walls 74. Each of the outer walls 74 contacts an outer surface 76 of each of the individual tiles 22, 24. The interaction between the outer wall 74 and the outer surfaces 76 helps to retain the tiles in the position illustrated.

In the embodiment shown, each vertical wall 74 includes a protruding ridge 78 that receives one end of a clip 80. The clip 80 engages the top end of each header section such that the top cap 70 further aids locking a pair of adjacent tiles together in the manner shown in FIG. 1.

Figure 8:
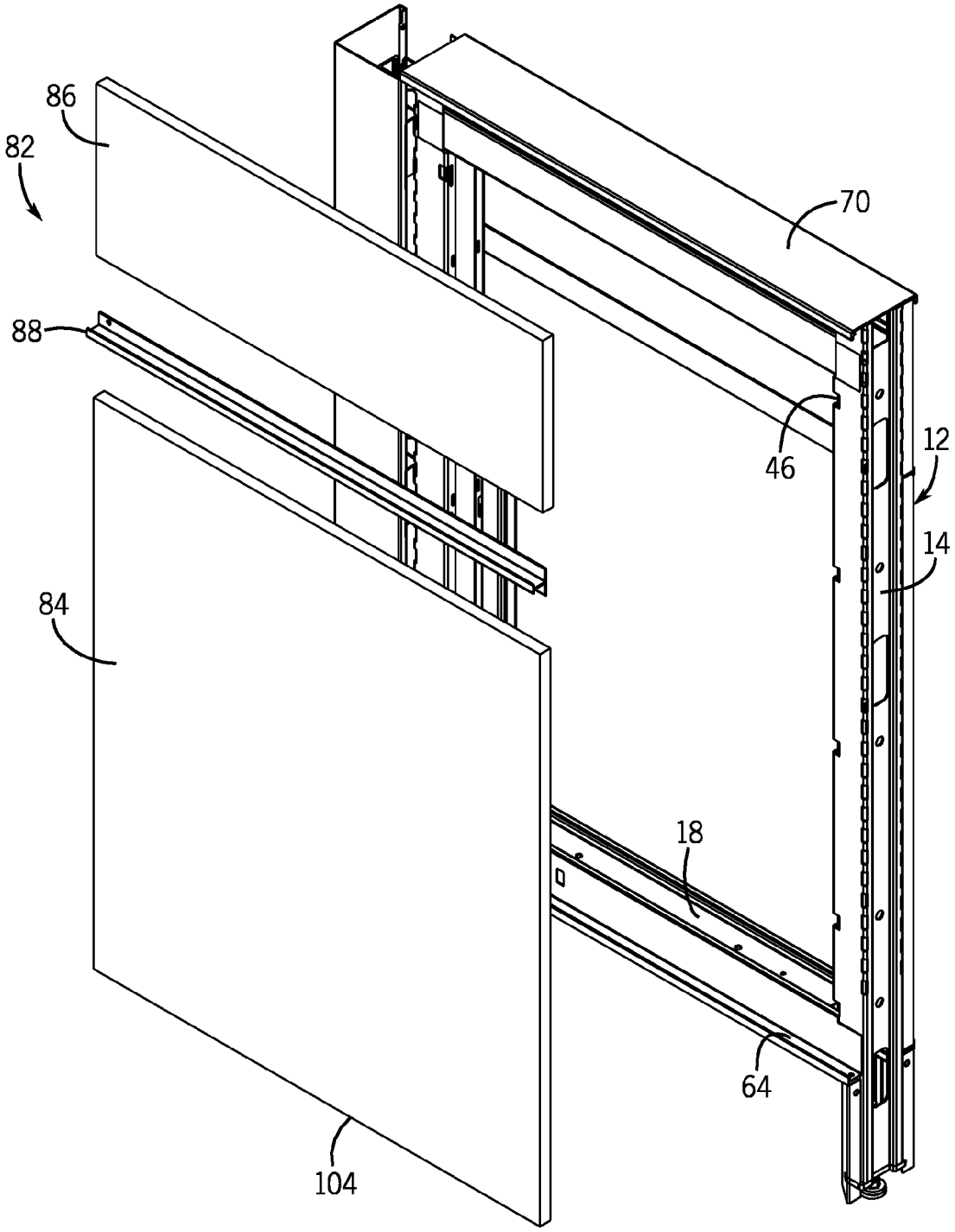
FIG. 8 is an exploded view of a multi-section tile.

FIG. 8 illustrates an alternate type of modular panel. In the embodiment shown in FIG. 8, the modular panel is a segmented panel that includes a segmented tile 82 having a lower portion 84 and an upper portion 86 that are joined to each other by a segmented trim channel 88. The trim channel 88 is positioned between the lower portion 84 and the upper portion 86 to create the segmented tile 82. It is contemplated that the lower portion 84 and the upper portion 86 could be formed having either different colors, different textures or having different materials formed on their outer surface.

As shown in FIG. 9, the trim channel 88 generally includes a back wall 90, a horizontal web 92 and a front wall 94. The trim channel 88 defines an upper trim channel 96 and a lower trim channel 98. Each of the upper and lower trim channels are defined by the back wall 90, the web 92 and the front wall 94. As illustrated in FIG. 9, the upper trim channel 96 receives the lowermost end 100 of the upper panel portion 86 while the lower trim channel 98 receives the upper end 102 of the lower panel portion 84.

The segmented tile 82 shown in FIG. 8 is installed as follows. Initially, the lower portion 84 is inserted into the lower trim channel 98. Once the trim channel 88 is installed onto the lower portion 84, the upper portion 86 is inserted into the upper trim channel 96 to form the entire segmented tile 82.

Once the segmented tile 82 is formed, the bottom end 104 of the lower panel portion 84 is inserted into the trim channel 64 formed in the lower sill 18. As described previously, the trim channel 64 of the lower sill 18 supports the entire weight of the segmented tile 82.

Once the weight of the segmented tile 82 is supported by the lower sill 18, stiffener brackets (not shown) on the back of the upper panel portion 86 are received in the attachment notches 46 near the top end of the vertical posts 14. Top cap 70 aids in further preventing the segmented tile 82 from falling away from the support frame 12.

As can be seen and as described, the trim channel 88 is free floating between the lower and upper panel portions 84, 86 of the segmented tile 82. Further, since the weight of the entire segmented tile 82 is supported by the trim channel 64, the segmented trim channel 88 is not required to support the weight of the tile but instead is simply used to hold the lower and upper portions 84, 86 in the orientation shown.

Figure 10:
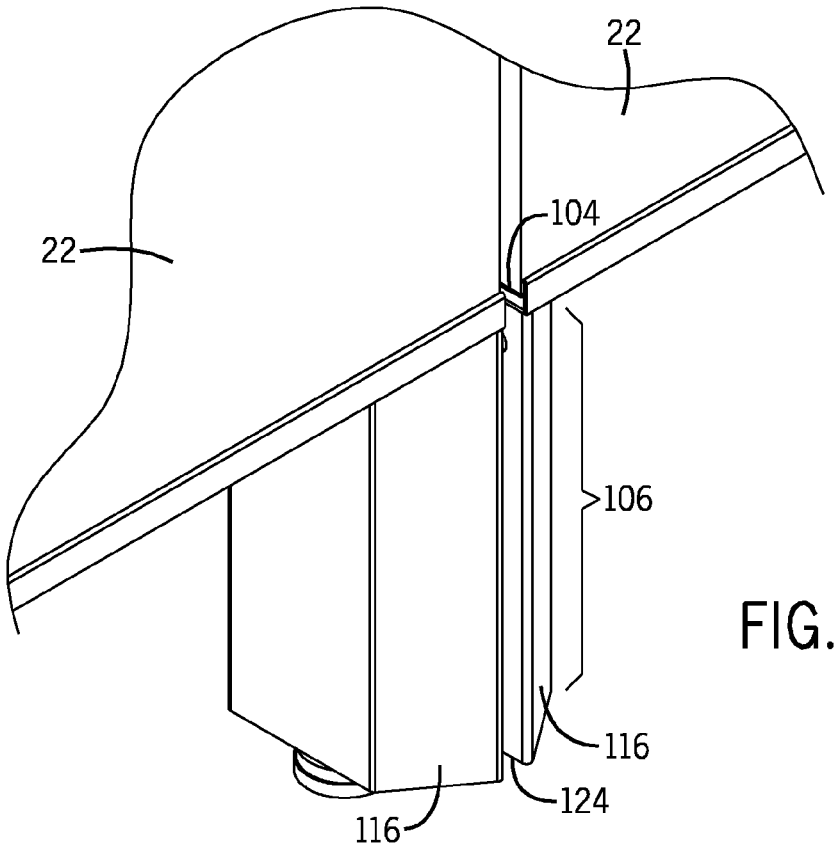
FIG. 10 is a perspective view illustrating the mounting of a pair of lower leg shrouds to the vertical posts of the support frame.

FIG. 10 illustrates a configuration in which each of the tiles 22 are supported by the modular panel system in a "lifted" or "raised" position. The term "lifted" or "raised" has been used to describe panels that have a bottom edge that is elevated above the floor, allowing for a more open feel. As illustrated in FIG. 10, the panels are lifted off the floor to create a space 106 between the bottom end 104 of the tile 22 and the floor.

Figure 11:
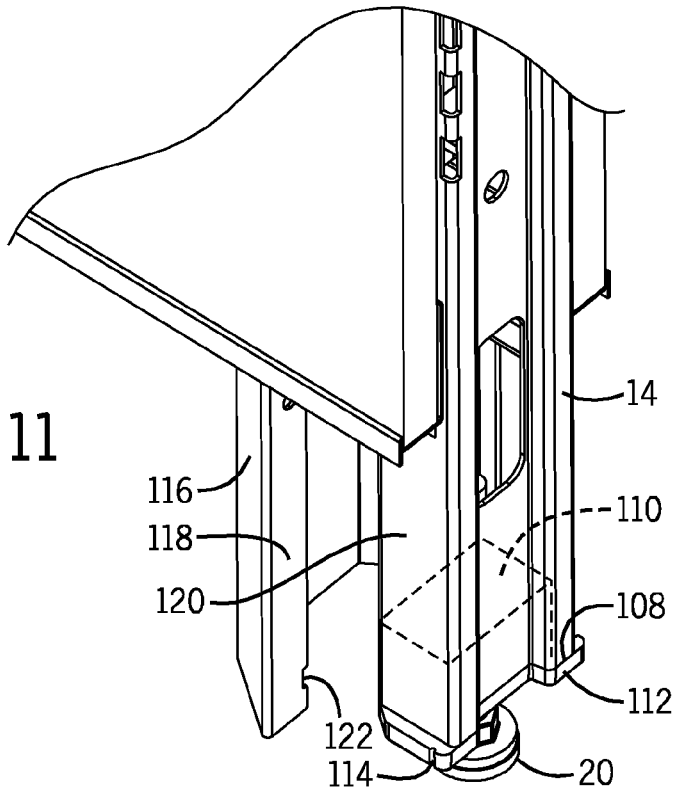
FIG. 11 is an exploded view of the leg shrouds of FIG. 10.

Referring now to FIG. 11, the bottom end 108 of the vertical post 14 receives an attachment block 110 that is received within the hollow, open lower end 108. The attachment block 110 includes a lower attachment flange 112. The lower attachment flange 112 includes one or more grooves 114.

As illustrated in FIG. 10, a pair of shrouds 116 are each mounted below one of the tiles 22 to shield the vertical post 14 to provide a decorative, overall pleasing visual appearance for the lower end of the vertical post 14. As shown in FIG. 11, each of the shrouds 116 includes an attachment flange 118 that extends generally perpendicular to face surface 120 of the vertical post 14. As shown in FIG. 8, each of the shrouds 116 engages notches formed in the sill 18. Referring back to FIG. 11, a notch 122 formed in the attachment flange 118 is received within one of the grooves 114 on the attachment block 110. When a pair of shrouds 116 are attached as shown in FIG. 10, only a small space 124 exists between the shrouds 116, which enhances the overall visual appearance as illustrated.

Figure 12:
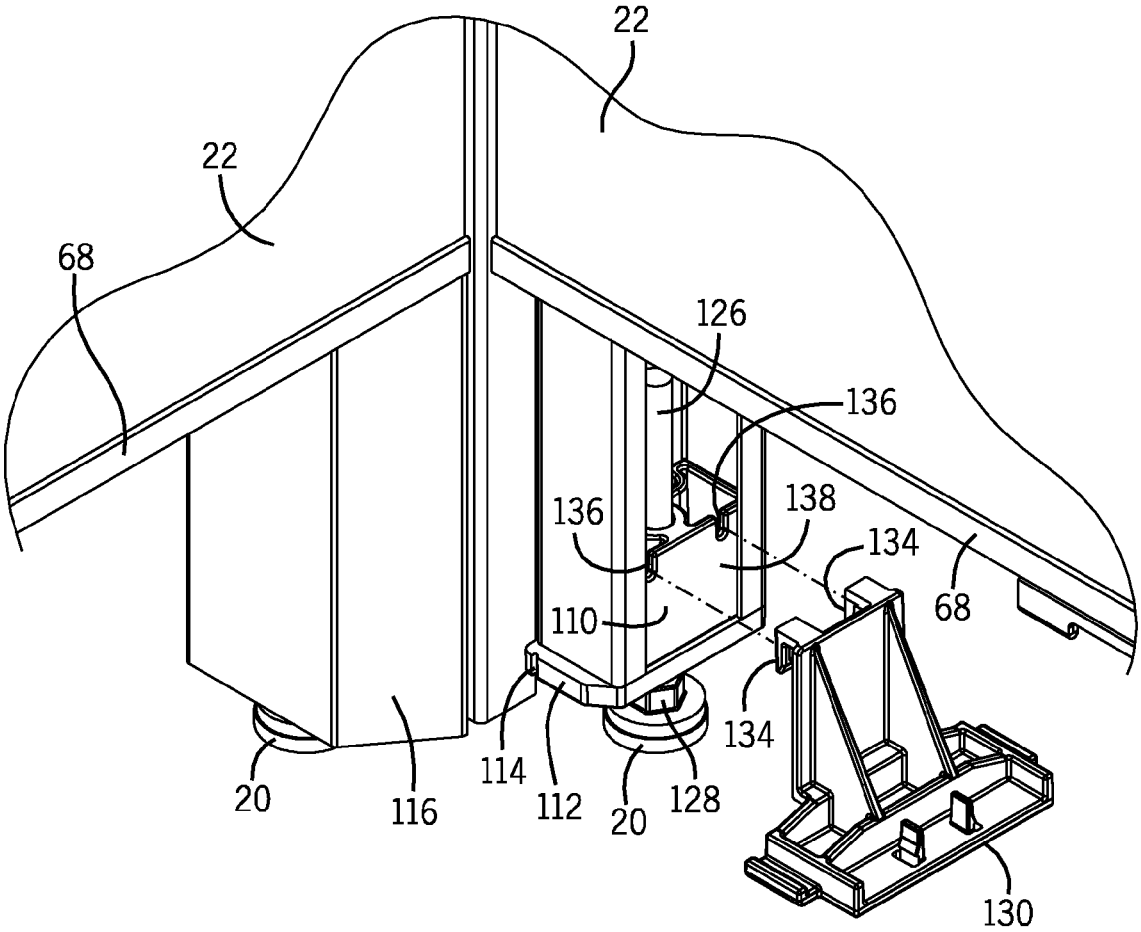
FIG. 12 is a perspective view illustrating the mounting of a raceway support to one of the mounting blocks secured in the lower end of one of the vertical posts.

Referring now to FIG. 12, the adjustable foot 20 is mounted to a threaded shaft 126 that extends through the attachment block 110. The foot 20 includes an engagement portion 128 that allows the foot 20 to be rotated causing the shaft 126 to move into and out of an internally threaded opening formed in the attachment block 110.

Figure 13:
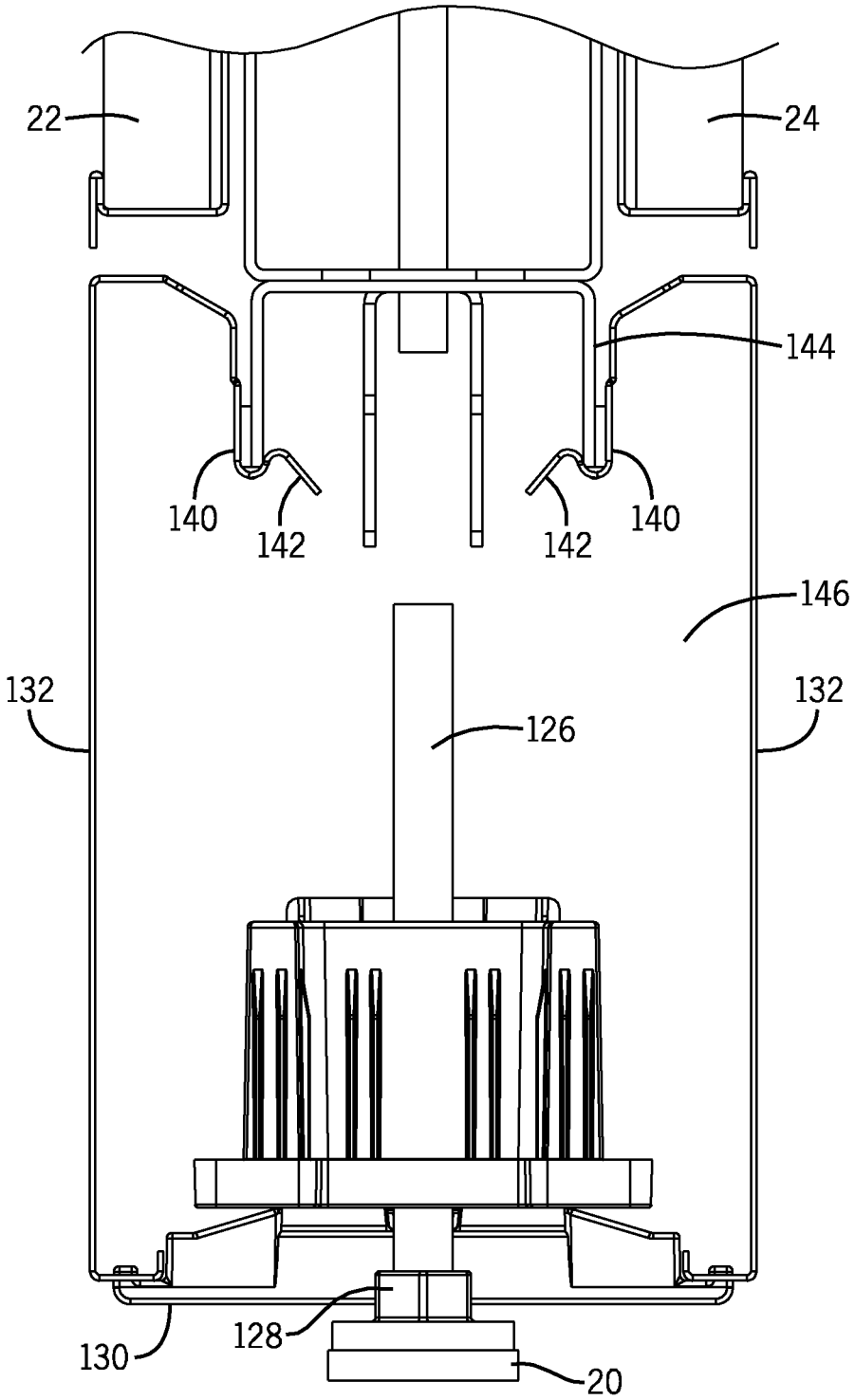
FIG. 13 is a side view illustrating a pair of trim panels mounted to the lower end of one of the panels.

In addition to providing a point of attachment for the shroud 116, the attachment block 110 also provides a point of attachment for a raceway support 130. Since the lowermost edge of each of the tiles 22 is spaced above the floor, the raceway support 130 provides a secure point of attachment for a pair of trim panels 132, as shown in FIG. 13. Referring back to FIG. 12, the raceway support 130 includes a pair of attachment hooks 134 that are received in corresponding notches 136 formed in the outer face 138 of the attachment block 110.

Referring back to FIG. 13, each of the trim panels 132 is attached at its lower end to the runway support 130. The upper end of the trim panel 132 includes an attachment arm 140 having a pair of tabs 142 that engage a raceway support bracket 144. The combination of the raceway support bracket 144 and the raceway support 130 allows the pair of trim panels 132 to enclose an open raceway 146 that extends along the length of the panel beneath the lower edges of the first tile 22 and the second tile 24.

Figure 14:
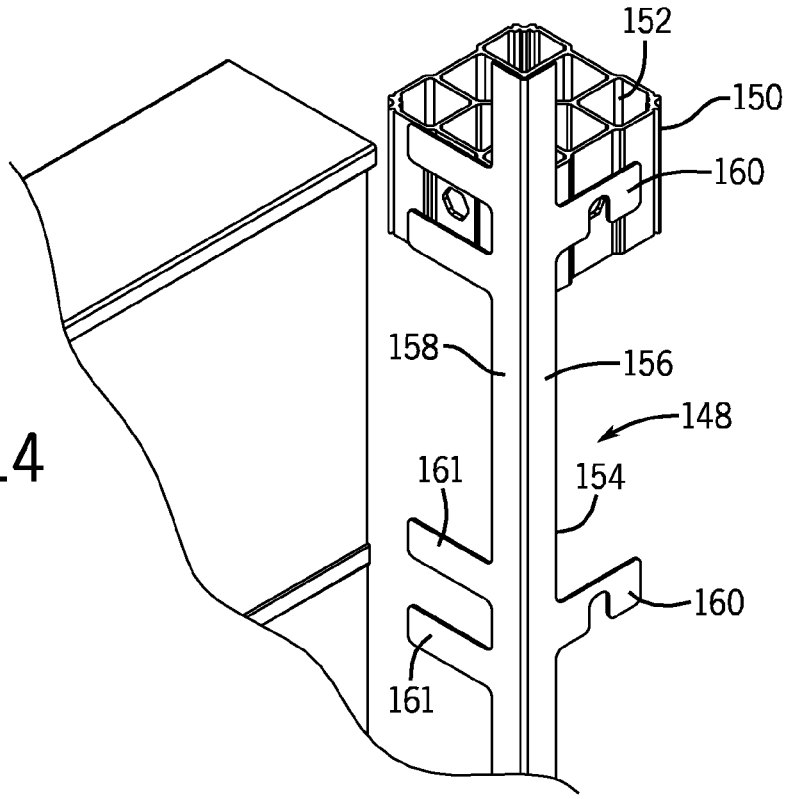
FIG. 14 is a perspective view of a light blocking bracket mounted to one or more support blocks positioned between a pair of panels.
Figure 16:
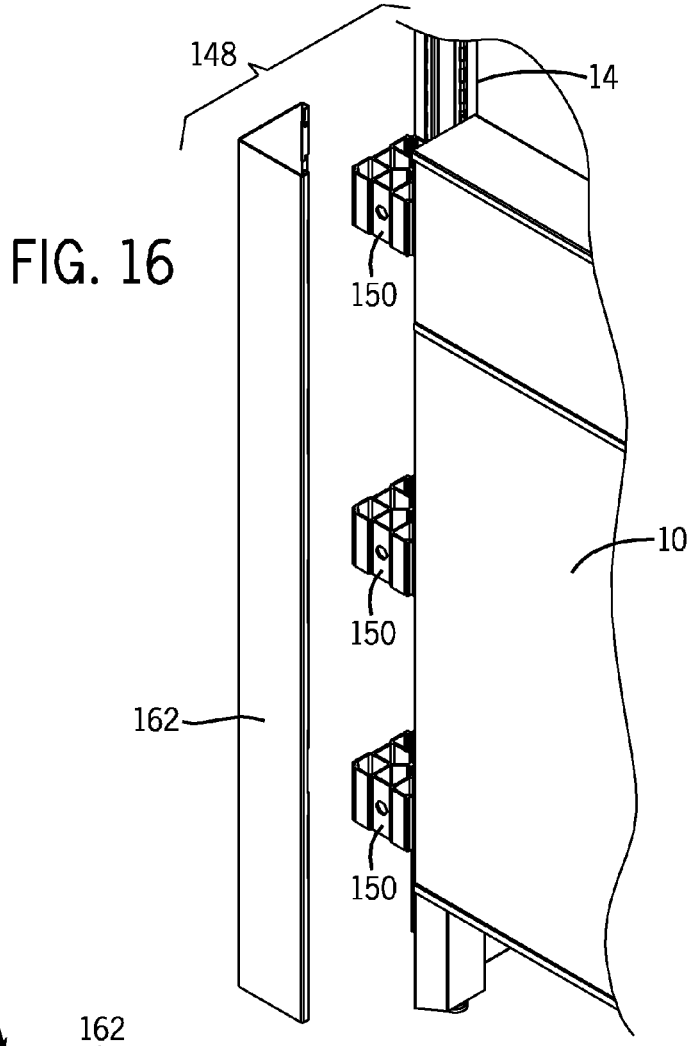
FIG. 16 is an exploded perspective view illustrating the mounting of the outer trim to a plurality of support blocks.
Figure 17:
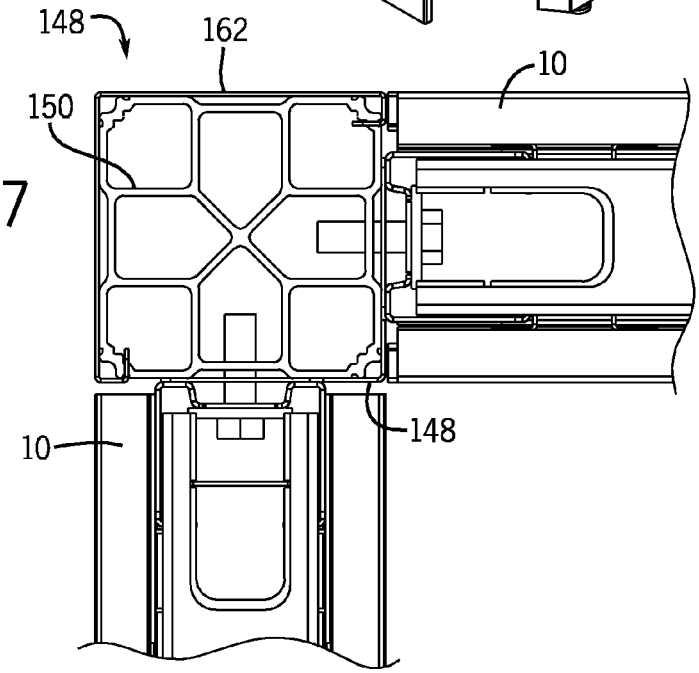
FIG. 17 is a top view of a pair of panels connected to the plurality of support blocks.

When a pair of panel sections are joined to each other at a 90° angle, it is possible that light may pass between the ends of each panel due to spacing between each of the two panels. To address this concern, the modular panel system includes a light block assembly 148 shown in FIG. 14. The light block assembly 148 includes one or more support blocks 150 initially mounted to the outer surface of one of the support posts that forms the modular panel. In the embodiment shown in FIG. 14, each support block 150 is a section of extruded plastic forming a web having a series of spaced openings 152. The spaced openings 152 provide a passage for wires to pass along the vertical height of the joined panels. The embodiment shown in FIG. 4 is particularly useful when a pair of panels form an interior corner as shown in FIGS. 16 and 17. In such a configuration, a light blocking bracket 154 is mounted to each of the support blocks 150. The light blocking bracket 154 extends along the entire height of each of the panels and includes first and second flange 156, 158 joined to each other at a 90° angle. The first flange 156 includes a pair of attachment tabs 160. The opposite flange 158 includes multiple pairs of tabs 161. As illustrated in FIG. 14, the tabs 160 and 162 are spaced such that they align with the support blocks 150 when the support blocks are attached as shown in FIG. 16.

Preferably, the light blocking bracket 154 is formed from a material, such as metal, that prevents the passage of light therethrough.

Figure 15:
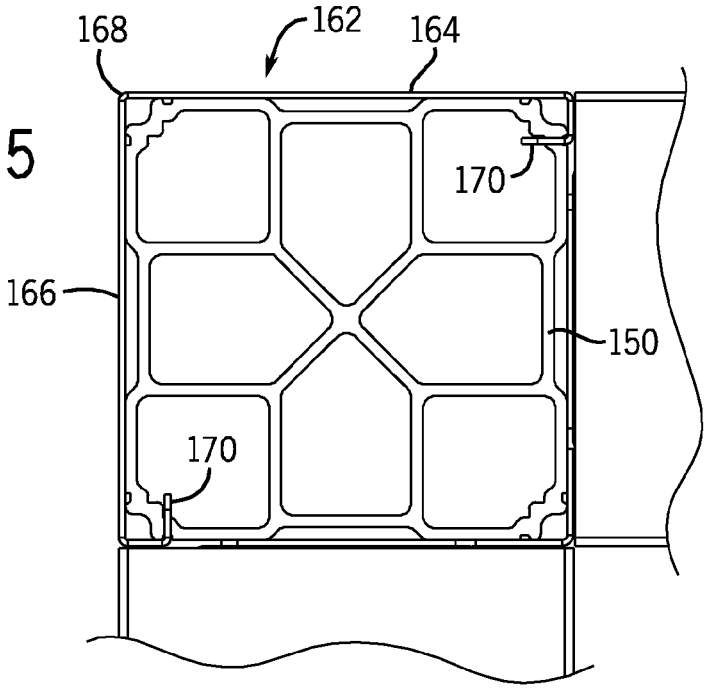
FIG. 15 is a top view of one of the support blocks that includes both the light blocking bracket and a section of outer trim.

Referring now to FIGS. 15-17, the light blocking assembly 148 further includes an outer trim section 162. The outer trim section 162 provides for an aesthetically pleasing outer facade of the modular panel system. As illustrated in FIG. 16, the outer trim section 162 is also mounted to the series of spaced support blocks 150.

As illustrated in FIG. 15, the outer trim section 162 includes a first sidewall 164 and a second sidewall 166 that are joined to each other at an apex 168. Both the first sidewall 164 and the second sidewall 166 include an attachment flange 170 that allows the outer trim section 162 to be secured to the support block 150.

Figure 18:
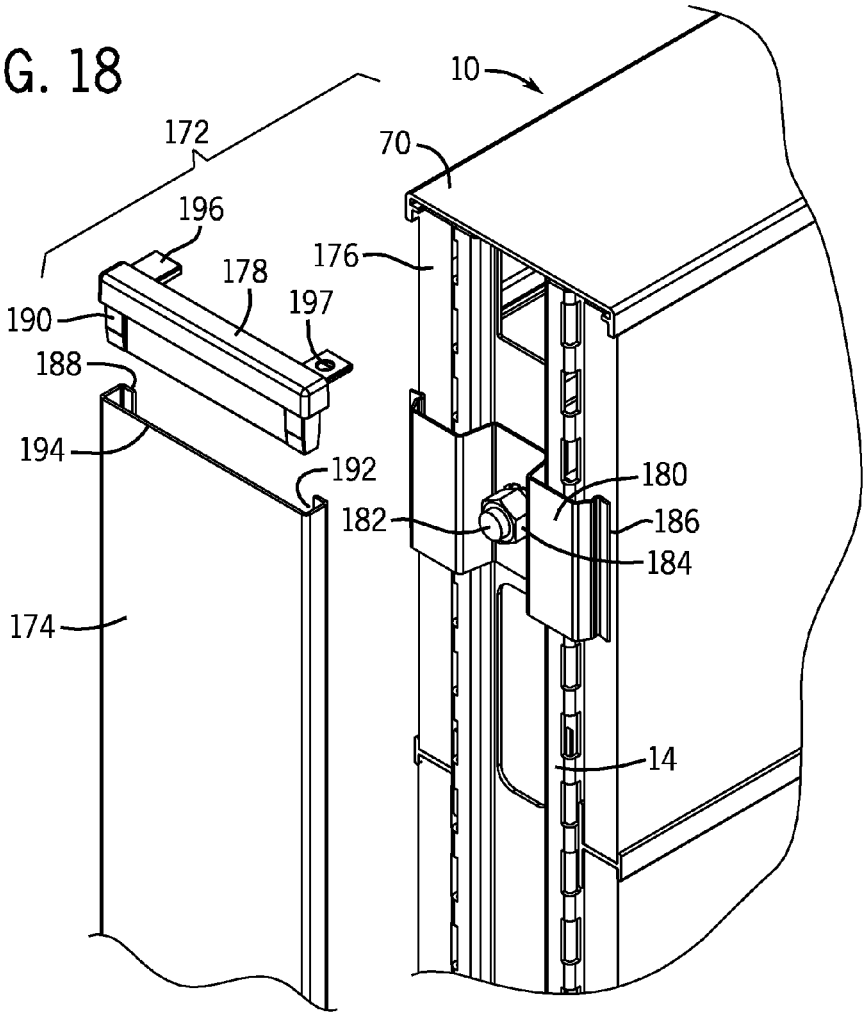
FIG. 18 is an exploded view illustrating the mounting of a trim section to an end-of-run clip.
Figure 19:
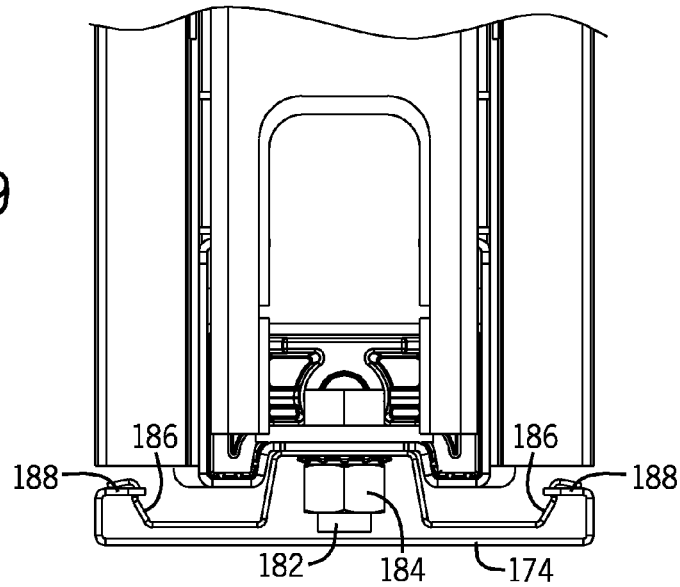
FIG. 19 is a top view illustrating the mounting of the trim section to the end-of-run clip.

FIGS. 18 and 19 illustrate an attachment assembly 172 for attaching a section of vertical trim 174 to an outer end 176 of a modular panel 10. The attachment assembly 172 includes the vertical trim section 174, a corner connector 178 and an end-of-run attachment clip 180. The attachment clip 180 is connected to the vertical post 14 by a threaded connector 182 including a lock nut 184. The attachment clip 180 includes a pair of outer attachment flanges 186. As illustrated in FIG. 19, each of the attachment flanges 186 receives and engages an arm 188 formed as part of the vertical trim section 174.

During installation, the corner connector 178 is initially positioned such that the attachment pegs 190 extend into and are retained within the attachment channel 192 created by the front wall 194 and the arms 188.

Once the corner connector 178 has been attached to the vertical trim section 174, the horizontal ears 196 are aligned with receiving channels formed in the top cap 70. Once aligned, the vertical trim section 174 is pushed forward until the vertical trim section 174 snaps in place on the attachment clip 180 and is retained by detent 197.

FIG. 20 illustrates a stacking section 198 that can be added to an existing modular panel 10 to increase the panel height. The stacking section 198 allows different portions of the panel system to be increased to either enhance the appearance of the modular panel system or for functional reasons.

The stacking section 198 shown in FIG. 20 includes a pair of shortened vertical post sections 200 that are each joined to each other by a header 202. The header 202 and vertical post sections 200 have the same overall configuration as the vertical post sections 14 and the header 16 that form part of the modular panel 10. The stacking section 198 includes a blade 204 securely attached to each of the shortened vertical posts 200, such as by welding. The blade 204 has a size to be received in the center section 28 between the pair of spaced contact projections 26. As illustrated in FIG. 21, when the shortened vertical post 200 is positioned on the header 16, the blade 204 extends into the center section 28 and is secured by a connector 206 and a lock nut 208. Once the connector 206 and lock nut 208 are in place, the vertical post 200 of the stacking section 198 is securely held in place.

Referring back to FIG. 20, the top cap 70 is secured to header 202 in the same manner as described previously to provide a visually pleasing appearance for the header section, as illustrated.

FIG. 22 illustrates an additional type of stacking section that includes a glass panel 210 mounted between a pair of side frame members 212. Each of the side frame members 212 slides over a pair of support posts 214. Each of the support posts 214 includes the blade 204 to secure the support posts 214 to the vertical post 14 of the modular panel 10. Top cap 70 is again secured to the cross support 216.

FIG. 23 illustrates a work surface 218 that can be utilized with the modular wall panel system of the present disclosure. The work surface 218 is supported by a front leg 220 joined to a rear leg 222 by a horizontal support 224. The work surface 218 allows the user to configure the panel system as desired to provide additional functionality for the panel system.

FIG. 24 illustrates the details of one embodiment of the work surface support. The support includes the rear leg 222 as described. Attached to the rear leg 222 is a fixed attachment bracket 226 that includes a series of ears 228 that are each received within the series of vertically aligned slots 44 formed in the vertical post 14. The interaction between the ears 228 and the slots 44 prevent the rear leg 222 from separating from the vertical post 14.

In addition to the fixed attachment bracket 226, the rear leg 222 also includes a movable bracket 230. The movable bracket 230 includes similar ears 232 that fit within the slots 44. The movable bracket 230 is attached to the rear leg 222 only after the rear leg has been placed in position and the ears 228 on the attachment bracket 226 are received within the slots 44. The movable bracket 230 thus allows the rear leg 222 to be locked in place once in the correct position on the vertical post 14.

In addition to the work surface shown in FIG. 24, the modular panel system can include a shelf 234 mounted to the vertical post 14 as shown in FIG. 25. In the embodiment illustrated, the shelf 234 includes a work surface 236 attached to a mounting bracket 238. The mounting bracket 238 includes a horizontal attachment plate 240 connected to a vertical mounting bracket 242 and having an angled support bar 244. The vertical mounting bracket 242 includes a series of ears that each fit within the slots 44 formed in the vertical post 14. The mounting bracket 238 allows the shelf 234 to be positioned in a desired location and secured to the vertical support post 14, as illustrated.

FIG. 26 illustrates the outer corner of a pair of modular panels 10 joined to each other along an outer corner 245. The outer corner 245 includes the outer trim section 162 and a pair of top caps 246. Each of the modular panels 10 in the embodiment shown in FIG. 25 includes an enhanced top cap 246. As illustrated in FIG. 25, the top cap 246 is mounted to the top edge of each of the modular panels 10 and abuts a corner section 248. FIG. 27 illustrates the specific configuration of the top cap 246. Top cap 246 is preferably formed from a molded or extruded material and defines a pair of side channels 250. The side channels 250 are formed between an upper lip 252 and a lower lip 254. The side channels 250 create channels that allow accessories, such as lights, wiring or other materials to be hung from the channel 250. Top cap 246 includes an outer wall 256 that contacts the outer surface 76 to help retain either the inner tile 22 or the outer tile 24 in the position shown.

Top cap 246 includes a pair of locking fingers that extend into an opening formed by the header 16 to lock the top cap 246 in the position shown in FIG. 27.

We claim:

1. A modular wall-type panel system comprising:

a series of individual panels each formed from a support frame having a pair of vertical posts and a horizontal header, wherein each of the vertical posts includes a pair of contact projections protruding from a recessed center section;

a plurality of connectors extending between the recessed center sections to connect the vertical posts of a pair of adjacent panels, wherein when the pair of panels are connected to each other by connectors, the pair of contact projections of each of the vertical posts of adjacent panels engage each other;

a bottom trim channel mounted between the pair of vertical posts;

at least one tile mounted to each support frame; and a top cap attached to each of the support frames.

2. The panel system of claim 1 further comprising a stacking section attached to the support frame to extend the height of the support frame, wherein the stacking section includes a pair of spaced vertical posts each having a blade connectable to the vertical posts of the support frame.

3. The panel system of claim 2 wherein the stacking section only includes a header extending between the pair of spaced vertical posts.

4. The panel system of claim 3 wherein the stacking section includes a glass panel positioned between the pair of vertical posts.

5. The panel system of claim 3 further comprising a top cap attached to the header of the stacking section.

6. The panel system of claim 1 further comprising:

a work surface mounted to at least one of the support frames; and a support leg attached to at least one vertical post and the work surface to support the work surface above the ground.

7. The panel system of claim 6 wherein the support leg includes a movable bracket that engages the vertical post to secure the support leg to the vertical post.

8. The panel system of claim 7 wherein the movable bracket is movable relative to the support leg to selectively secure the support leg to the vertical post.

9. A modular wall-type panel system comprising:

a series of individual panels each formed from a support frame having a pair of spaced vertical posts and a horizontal top header;

at least one tile mounted to each support frame;

a light blocking attachment assembly for joining a pair of panels at a 90° angle relative to each other, the light blocking assembly comprising a plurality of support blocks each having a generally square cross-section and four attachment surfaces, wherein each of the panels are attached to one of the attachment surfaces; and at least one light blocking bracket positioned between the support blocks and the panels, wherein the light blocking bracket includes a pair of flanges joined to each other at a 90° angle and extends along the length of each panel to prevent light from passing between the two panels.

10. The panel system of claim 9 further comprising a corner trim section attached to the plurality of support blocks and covering the attachment surfaces not in contact with one of the panels.

* * * * *